US009522307B2

(12) United States Patent
Yeh et al.

(10) Patent No.: US 9,522,307 B2
(45) Date of Patent: Dec. 20, 2016

(54) CUSTOMIZABLE GOLF BALL AND METHOD OF PROVIDING A CUSTOMIZABLE GOLF BALL

(75) Inventors: Shi-Hsien Yeh, Yun-lin Hsien (TW); Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 1244 days.

(21) Appl. No.: 13/408,193

(22) Filed: Feb. 29, 2012

(65) Prior Publication Data

US 2013/0225332 A1 Aug. 29, 2013

(51) Int. Cl.
*A63B 37/00* (2006.01)
*A63B 45/00* (2006.01)
*A63B 45/02* (2006.01)

(52) U.S. Cl.
CPC ..... *A63B 45/00* (2013.01); *A63B 37/0003* (2013.01); *A63B 37/0031* (2013.01); *A63B 37/0039* (2013.01); *A63B 37/0043* (2013.01); *A63B 37/0062* (2013.01); *A63B 37/0075* (2013.01); *A63B 37/0092* (2013.01); *A63B 37/0097* (2013.01); *A63B 37/0022* (2013.01); *A63B 45/02* (2013.01)

(58) Field of Classification Search
CPC ..... A63B 45/00
USPC ..... 473/409, 351
See application file for complete search history.

(56) References Cited

U.S. PATENT DOCUMENTS 808,683 A 1/1906 Richards
4,653,758 A 3/1987 Solheim
5,820,485 A * 10/1998 Hwang ..... 473/361
5,836,834 A 11/1998 Masutani et al.
6,106,415 A * 8/2000 Masutani et al. ..... 473/374
6,440,346 B1 8/2002 Wai et al.
6,629,898 B2 10/2003 Nardacci
6,759,482 B1 * 7/2004 Yokota ..... 525/261
6,797,097 B2 9/2004 Boehm et al.
7,169,065 B2 1/2007 Ninomiya et al.
7,261,432 B1 8/2007 Habitz
7,377,863 B2 5/2008 Sullivan et al.
2008/0248898 A1 * 10/2008 Morgan et al. ..... 473/373
2010/0056300 A1 3/2010 Cooper et al.
2012/0094784 A1 * 4/2012 Hebert et al. ..... 473/374

FOREIGN PATENT DOCUMENTS

FR 2836054 8/2003

OTHER PUBLICATIONS

Celestial Wooden Vintage Nesting Balls, Etsy Listing, 1980s.*

* cited by examiner

*Primary Examiner* — Raeann Gorden

(74) *Attorney, Agent, or Firm* — Quinn Law Group, PLLC

(57) ABSTRACT

The present disclosure is directed to a golf ball and a method for providing a golf ball that is customizable by a golfer to achieve a golfer's desired playing characteristics. The customizable golf ball includes multiple layers of customizable thermoplastic or thermoset materials in varying hardness levels that may be assembled by the golfer to achieve a desired feel in play. After play, the customizable golf ball may be disassembled to again vary the playing characteristics of the ball by substituting layers of varying hardness levels, or to simply replace old or worn out parts.

16 Claims, 17 Drawing Sheets

CUSTOMIZABLE GOLF BALL AND METHOD OF PROVIDING A CUSTOMIZABLE GOLF BALL

BACKGROUND

The present disclosure relates generally to a customizable golf ball and a method for providing a customizable golf ball to a golfer.

Golf is a sport that enjoys wide popularity around the world and is played by golfers of all ages, from young to old. To aid and improve their performance, golfers continually search for and adopt the best and newest equipment, including golf clubs, golf balls, apparel and training devices. To that end, there are many equipment choices available, including a number of different golf ball brands and types, each designed to exhibit certain characteristics in play. Golfers typically buy golf balls in a finished state, i.e. ready-to-use, and select a ball that is most suitable for a desired combination of performance characteristics or that is designed for their skill level.

Golf ball constructions may generally include a core made from a resilient material and a cover made from a more durable material, such as synthetic resin. The core is typically made from rubber or a similar material and may have a wound or solid construction. Intermediate layers made from a variety of materials may be provided between the core and cover to vary the perceived feel when the ball is hit, or to exhibit certain performance characteristics in play. Typically, golfers must search for ready-to-use balls with constructions that achieve their desired feel and performance.

SUMMARY

The present disclosure is directed to a golf ball and a method for providing a golf ball that is customizable by a golfer to achieve his or her desired feel and/or performance characteristics. The customizable nature of the disclosed golf ball also allows a golfer to replace or refurbish old or worn-out parts of the ball.

In one aspect, the disclosure provides a method of providing a customizable golf ball to a golfer. The method includes the steps of providing an inner core piece having a first hardness, providing at least two intermediate layer pieces having a second hardness, and providing at least two cover pieces having a third hardness. According to the method, the intermediate layer pieces have interior surfaces configured to mate with an exterior surface of the inner core piece, and the intermediate pieces substantially form a sphere when joined. In addition, the interior surfaces of the at least two cover pieces are configured to mate with an exterior surface of the at least two intermediate layer pieces, and together the at least two cover pieces substantially form a sphere.

In another aspect, the disclosure provides an additional method of providing a customizable golf ball to a golfer. The method involves providing an inner core piece that includes a plurality of apertures, and providing a plurality of tenons, whereby portions of the tenons may be fitted within some or all of the apertures. The method also includes providing at least two intermediate layer pieces configured to create a spherical cover for the inner core piece and that further include interior surfaces with a plurality of apertures for receiving portions of the tenons. The method further includes providing at least two cover pieces configured to mate with and create a spherical cover for the at least to intermediate layer pieces.

In another aspect, the disclosure provides yet another method of providing a customizable golf ball to a golfer. The method involves providing an inner core piece having a plurality of arcuate protrusions evenly spaced around the inner core piece, and beginning at one pole of the inner core piece and ending at an opposite pole of the inner core piece. Further, the method involves providing at least two cover pieces having interior surfaces including a plurality of grooves for receiving the arcuate protrusions of the inner core piece to form a two layer golf ball when assembled. Optionally, two intermediate layer pieces may be provided that are configured to create an intermediate cover layer sphere surrounding the inner core piece, and having interior surfaces including a plurality of grooves for receiving the arcuate protrusions of the inner core piece. The at least two cover pieces may configured to mate with and create a spherical cover for the at least two intermediate layer pieces, forming a three layer golf ball.

In another aspect, the disclosure provides yet another method of providing a customizable golf ball to a golfer. The additional method involves providing an inner core piece having a first hardness. The method further includes providing at least two cover pieces comprising a second hardness. The interior surfaces of the at least two cover pieces are further configured to mate with an exterior surface of the inner core piece and to join together to form a sphere.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The present disclosure relates to golf balls that may be customized by a golfer, and methods for providing customizable golf balls.

The performance of a golf ball may be driven by a number of factors including: the materials that are used to make the ball; the number of layers within the ball; the hardness and/or density of the material that makes up each layer; the thickness of each layer; and the way the layers are assembled to form the ball. Each of these features may affect the feel of the ball when it is struck by a golf club as well as the performance of the ball in flight and after touchdown, including the maximum velocity and spin rate achieved by the ball in flight. For example, golf balls with multiple internal layers may exhibit higher maximum spin rates after impact with a club face. Other features of the core may result in lower spin rates but increased velocity and distance. Golfers typically select a ball based on a desired combination of playing characteristics, often dependent upon the golfer's skill level. According to embodiments set forth herein, golfers may customize a golf ball, such as golf ball 10 of FIG. 1, to achieve the exact playing characteristics desired.

Figure 1:
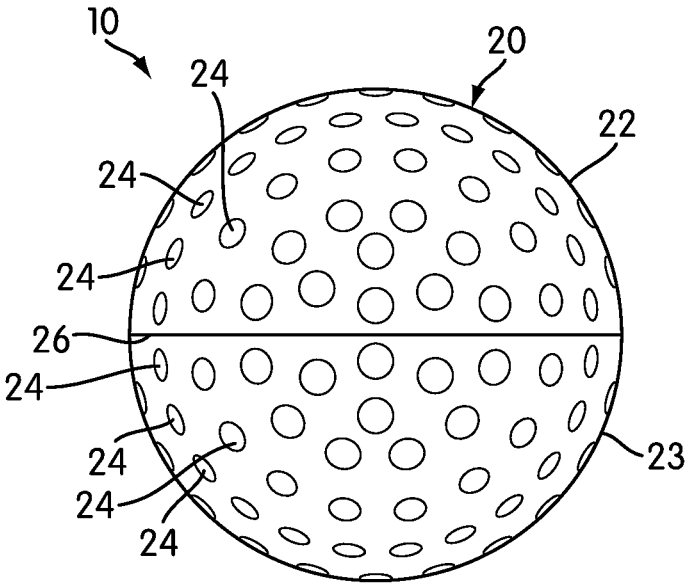
FIG. 1 is an elevational view of an embodiment of a customizable golf ball.

FIG. 1 depicts a customizable golf ball 10, according to at least one embodiment described herein. According to FIG. 1, golf ball 10 includes an external cover 20 comprising a first cover piece 22 and a second cover piece 23. External cover 20 may be provided with a plurality of dimples 24 arranged in a pattern. According to aspects set forth herein, first cover piece 22 and second cover piece 23 may be generally hemispherical in shape and joined together at a seam 26 such that golf ball 10 has a spherical shape. Golf ball 10 may look and feel very similar to currently available golf balls with respect to exterior variations in color, external markings, dimple patterns and cover hardness. Internally, however, golf ball 10 may exhibit a variety of features made from a variety of materials.

Figure 2:
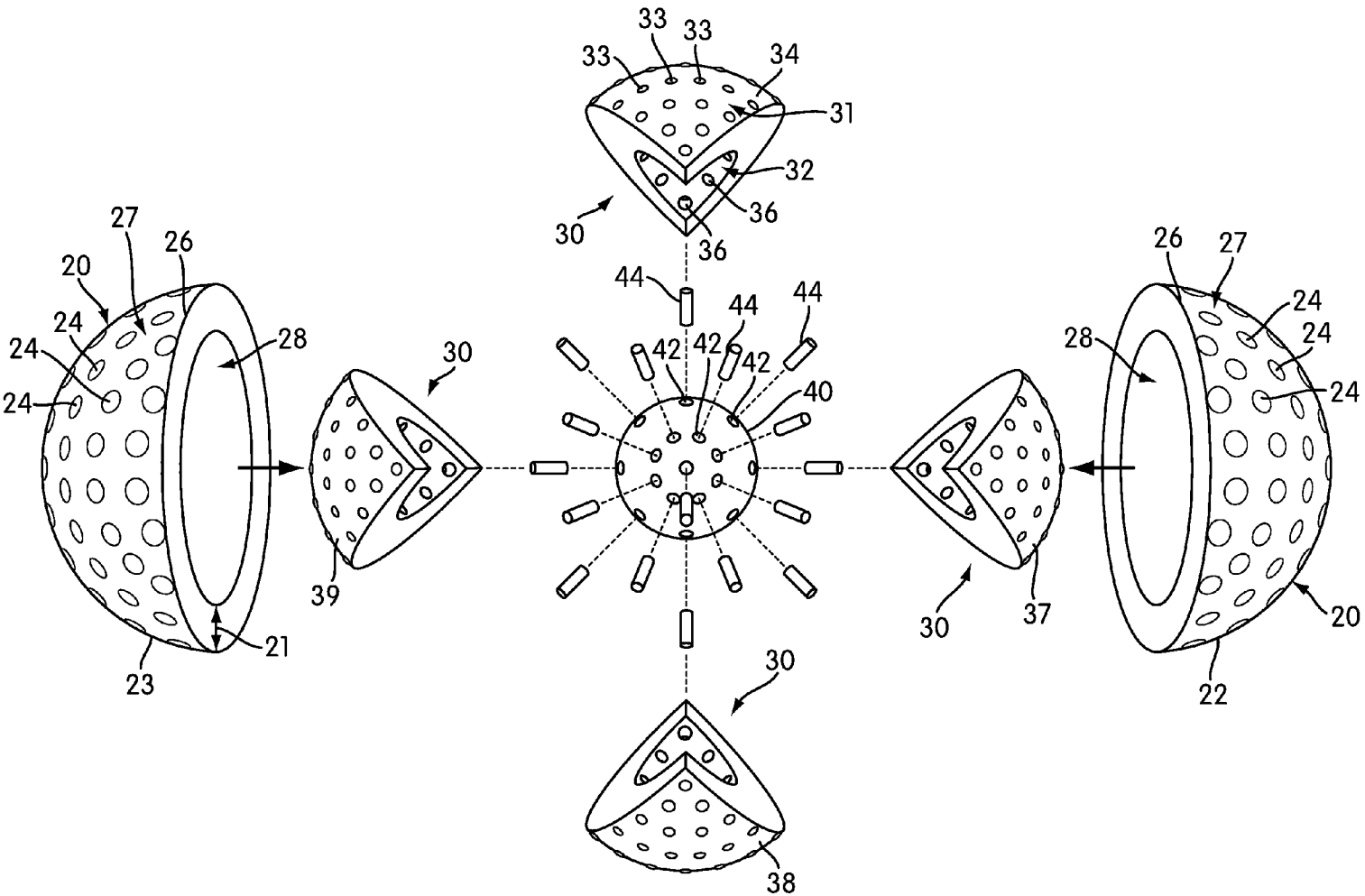
FIG. 2 is an exploded view of an embodiment of a customizable golf ball.

As depicted in the exploded view of golf ball 10 in FIG. 2, an embodiment of customizable golf ball 10 exhibits a layered structure having (a) a cover 20 that forms an exterior portion of golf ball 10, (b) an optional intermediate layer or mantle shell 30 located under cover 20, and (c) an internal core 40 that forms an interior portion of ball 10. According to an embodiment set forth herein, golf ball 10 may also include a plurality of tenons 44 situated in apertures or core mortises 42 on core 40 as well as in mantle mortises 36 on an interior surface 32 of mantle shell 30. As discussed in more detail below, a golfer may customize golf ball 10 by selecting layers of varying materials and varying hardnesses to achieve desired performance or playing characteristics, such as feel, spin, velocity or trajectory.

Figure 3:
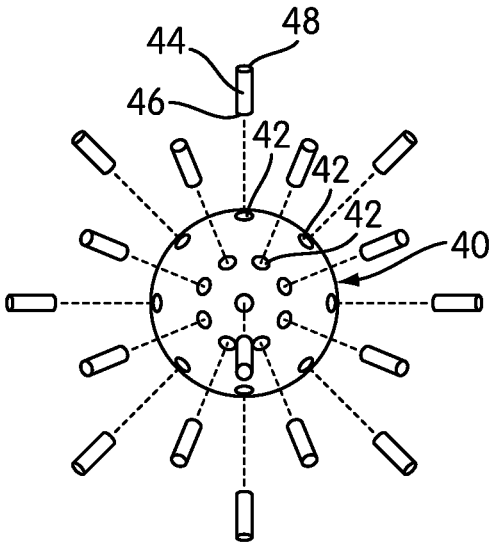
FIG. 3 is an exploded view of an embodiment of a portion of a customizable golf ball.
Figure 4:
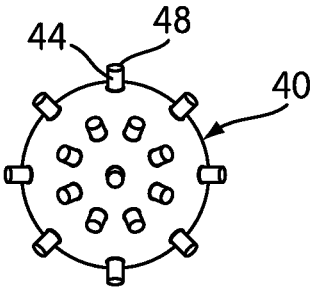
FIG. 4 is an elevational view of an embodiment of a portion of a customizable golf ball.

According to at least one embodiment, the internal core 40 may comprise a solid spherical structure with a plurality of core apertures 42 spaced evenly over the surface of core 40 for receiving a plurality of cylindrical tenons 44, as shown in FIGS. 3 and 4. Core apertures 42 may be sized and shaped to receive similarly sized and shaped tenons 44. Tenons 44 may be cylindrically shaped with a first end 46 placed in an aperture 42 on core 40 and a second end 48 placed in a similarly sized and shaped aperture 36 on an interior surface 32 of mantle shell 30, as further set forth below. Those skilled in the art will appreciate that the number of tenons 44 may be fewer or more than is depicted in FIGS. 3 and 4 and still achieve the desired effect, described below. Furthermore, those skilled in the art will readily appreciate that the tenon/mortise construction may also be achieved using a variety of different shapes, such as triangular-shaped tenons, rectangular-shaped tenons, pentagonal-shaped tenons, hexagonal-shaped tenons, or other kind of polygonal-shaped tenons, without altering the spirit and scope of the customizable golf ball set forth herein.

Figure 5:
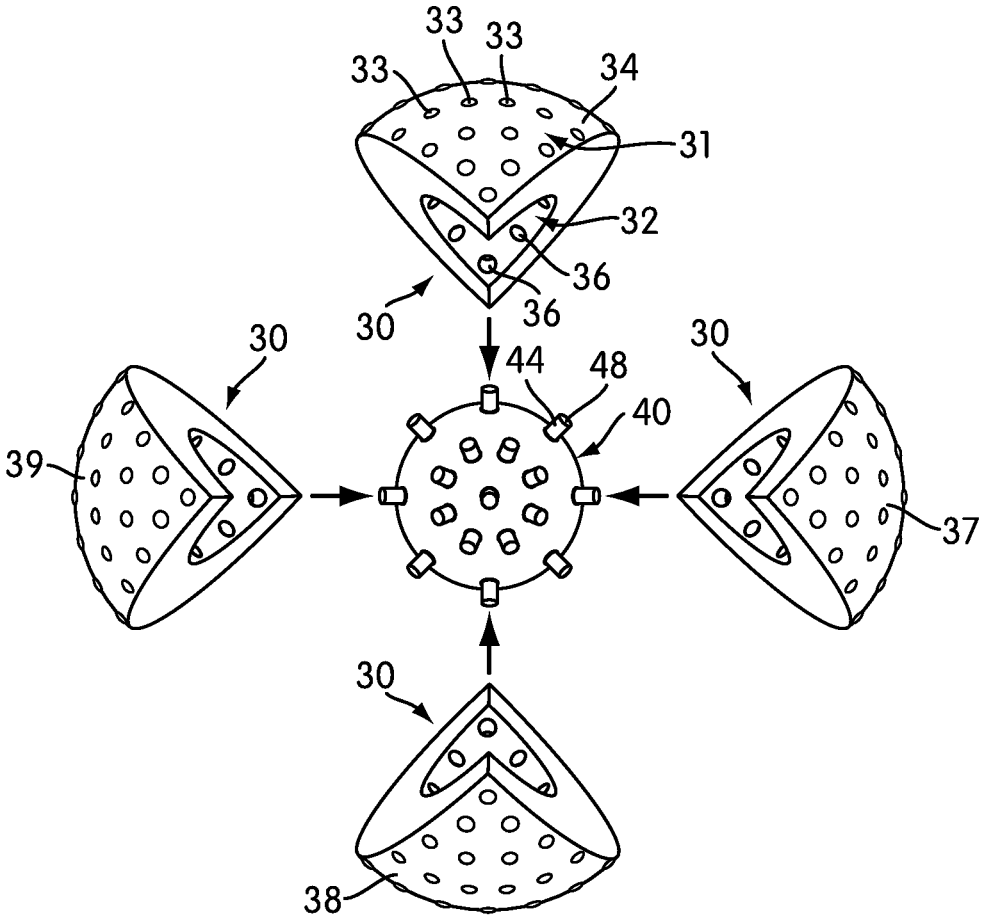
FIG. 5 is an exploded view of portions of an embodiment of a customizable golf ball.
Figure 6:
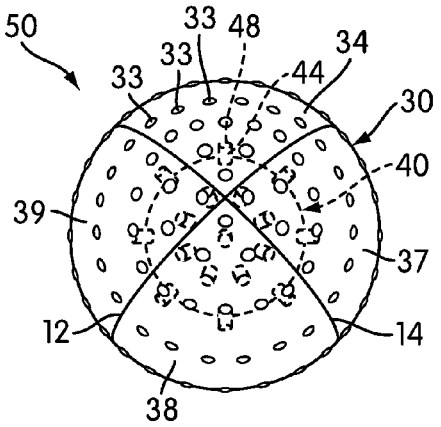
FIG. 6 is an elevational view of portions of an embodiment of a customizable golf ball.

Referring to the embodiment of FIGS. 5 and 6, mantle shell 30 may be comprised of four quarter-sphere pieces, first quarter-sphere piece 34, second quarter-sphere piece 37, third quarter-sphere piece 38, and fourth quarter-sphere piece 39. FIG. 5 depicts an exploded view of how mantle shell 30 may be placed over core 40 and FIG. 6 depicts the two layers in place together. Mantle shell 30 may also comprise two half-sphere pieces as shown in the embodiments depicted in FIGS. 11-16, discussed below. Mantle shell 30 has an exterior surface 31 and an interior surface 32 that is sized and shaped to mate with internal core 40. In the embodiment depicted in FIGS. 5 and 6, interior surfaces 32 of first quarter-sphere piece 34, second quarter-sphere piece 37, third quarter-sphere piece 38, and fourth quarter-sphere fourth quarter-sphere piece 39 exhibit a plurality of spaced apart cylindrically-shaped mantle apertures 36 that are sized and shaped to receive cylindrically-shaped tenons 44 protruding from core 40. When fitted together as seen in FIG. 6, core 40, tenons 44 and mantle shell 30 together create a tenon and mortise construction, and first quarter-sphere piece 34, second quarter-sphere piece 37, third quarter-sphere piece 38, and fourth quarter-sphere piece 39 of mantle shell 30 fit together along seam line 12 and seam line 14.

The exterior surface 31 of mantle shell 30 may also include provisions that can impact the ball's structure, according to aspects set forth herein. For example, the exterior surface 31 of mantle shell 30 may include small projections 33 to assist with positioning cover 20 over mantle shell 30. In the embodiment shown in FIGS. 5-7, projections 33 create small spherical protrusions on the exterior surface 31 of mantle shell 30. It should be understood that projections 33 may be sized and shaped in a variety of manners, or may be absent altogether, and still meet the spirit and scope of the present disclosure.

Figure 7:
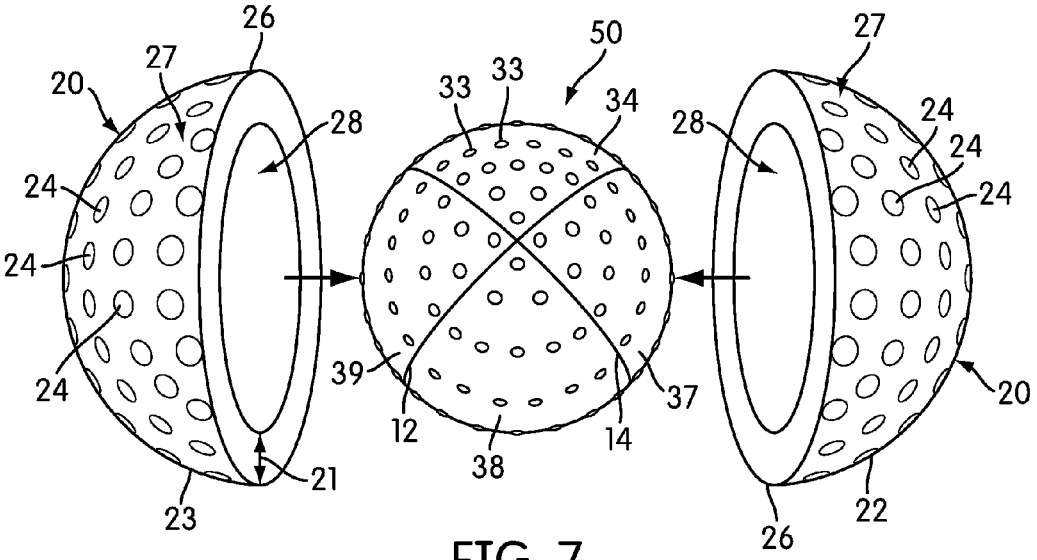
FIG. 7 is a partially exploded view of an embodiment of a customizable golf ball.

After core 40 is covered by mantle shell 30 to form a complete inner ball 50 as in FIGS. 6 and 7, inner ball 50 may be covered by two dimpled cover shells 22 and 23. FIG. 7 depicts an exploded view of how cover 20 may be placed over inner ball 50 to create finished golf ball 10 (as seen in FIG. 1). Cover 20 has an exterior surface 27 separated from an interior surface 28 by a thickness 21 selected to allow the interior surface to mate with inner ball 50. In particular, thickness 21 may be decreased or increased based on the size of inner ball 50. In the embodiment depicted in FIGS. 5 and 6, interior surfaces 28 are smooth, and projections 33 on inner ball 50 may be pressed against interior surfaces 28; however, in other embodiments, interior surfaces 28 may have impressions that are sized and shaped to receive projections 33. When fitted together as seen in FIGS. 1 and 7, first cover piece 22 and second cover piece 23 come together at seam line 26. Referring to FIG. 7, seam line 26 of cover 20 may be offset from seam line 12 and seam line 14 of mantle shell 30 to increase durability across the layers of golf ball 10.

Internal core 40, tenons 44, intermediate mantle shell 30, projections 33, and cover 20 may all be made from a variety of thermoplastic or thermoset materials in a variety of hardness levels to achieve desired playing characteristics. Exemplary thermoplastic materials may include, but are not limited to, ionomer resins, highly neutralized acid polymer compositions, polyamide resins, polyester resins, polyurethane resins, or a combination thereof. Exemplary thermoset materials may include, but are not limited to, natural and synthetic rubber and rubber compositions, polyurethane elastomers, polyamide elastomers, polyurea elastomers, diene-containing polymers, crosslinked metallocene catalyzed polyolefins, silicones, or combinations thereof. Those skilled in the art will readily acknowledge the full breadth of materials available for use beyond those specified, that would still fall within the spirit and scope of the present disclosure.

According to aspects described herein, the hardness of the layers of golf ball 10 may be assessed using techniques well-known in the art. In some cases, a durometer measurement may be taken on the surface of any of the layers of golf ball 10. For example, a Shore® durometer measurement may be taken using the Shore scales set forth in the ASTM D2240 testing standards. In at least one embodiment, the hardness of the layers may be assessed using the ASTM D2240 Type D scale (also known as Shore D), as is well-known in the art. In other cases, the ASTM D2240 Type C or other scales may be used to assess the hardness of each of the layers. In still other cases, other well-known methods for measuring hardness may be used, such as JIS-C or JIS K 6253.

According to the present disclosure, the surface hardness level relationship between the layers of golf ball 10 may be dictated by the golfer assembling the customizable ball (assembly discussed in further detail below).

To achieve a variety of desired playing characteristics, a golfer may customize golf ball 10 by using materials of varying hardness levels for the multiple layers of golf ball 10. For example, tenons 44 may have the same or a different surface hardness level from that of core 40 and mantle shell 30. Likewise, projections 33 on mantle shell 30 may have the same or a different surface hardness level from that of mantle shell 30. In addition, the hardness level of core 40 tenons 44 and mantle shell 30 may each be higher or lower in relation to the hardness level of cover 20. As is known in the art, the variation in hardness levels among the multiple layers can create a different feel when the ball is hit. A golfer may customize the feel of golf ball 10 to his/her particular skill level or liking by using layers of varying hardness levels, varying thicknesses or varying materials throughout golf ball 10.

While the hardness level of the layers of the varying embodiments described herein may be any desired value known in the art, typical golf ball configurations include a cover layer that is softer than the mantle shell, as well as a mantle shell that is harder than the core. In particular, hardness levels according to at least one embodiment set forth herein may be in the following ranges: a cover layer with a Shore hardness range between about 25 and 60; an intermediate mantle shell layer with a Shore D hardness range between about 40 and 80; and a core with a Shore D hardness range between about 30 and 65.

Figure 8:
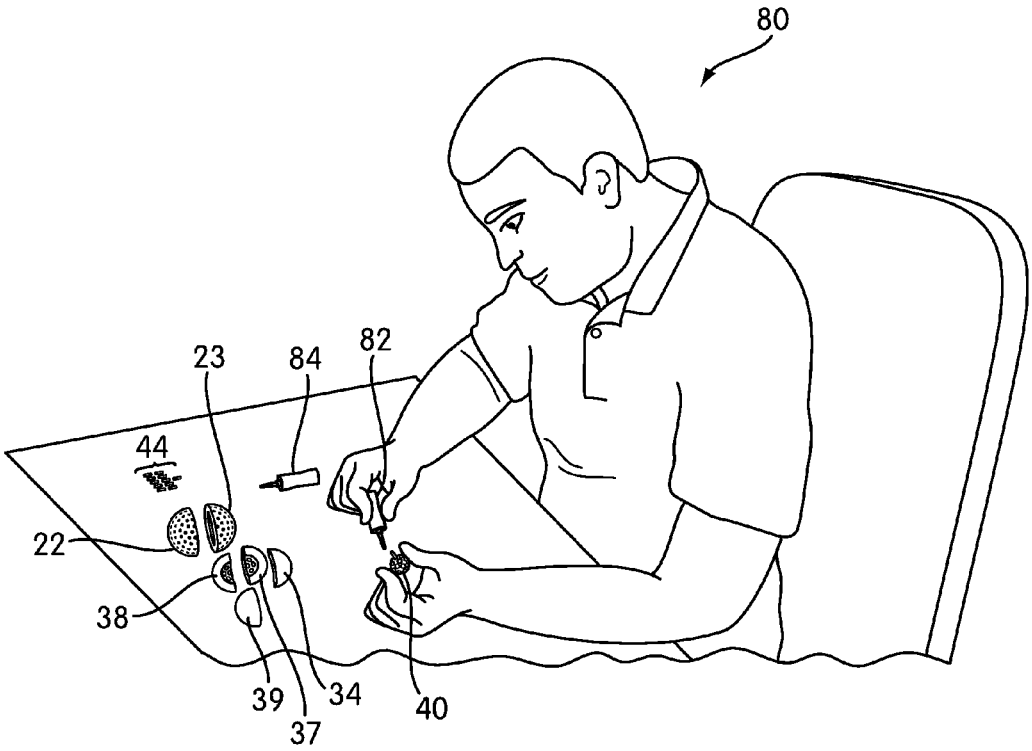
FIG. 8 is a perspective view of a golfer assembling an embodiment of a customizable golf ball.
Figure 9:
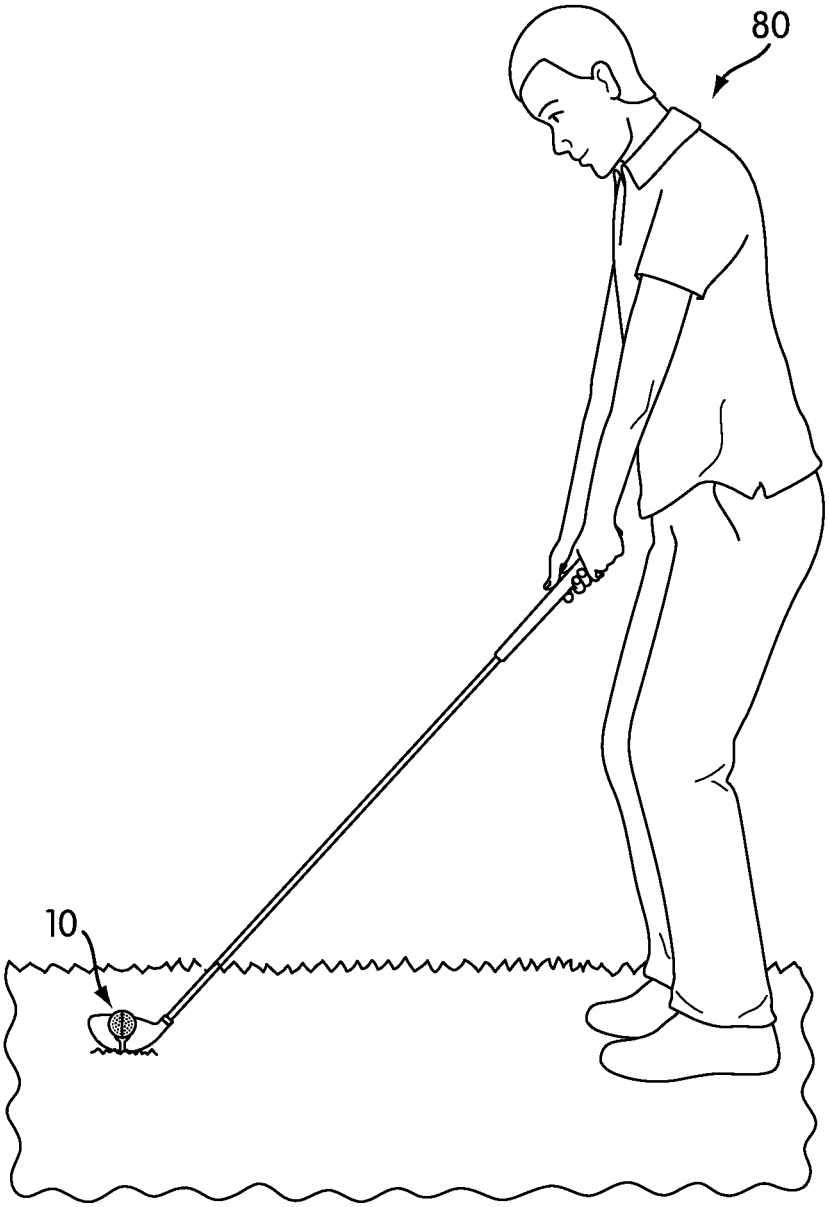
FIG. 9 is a perspective view of a golfer using an embodiment of a customizable golf ball.

FIG. 8 depicts a golfer 80 in the beginning stages of assembling a customizable golf ball 10, i.e., joining a tenon 44 to core 40, according to at least one embodiment set forth herein. Also present in FIG. 8 are additional layers of golf ball 10 that have not yet been fully assembled, i.e., mantle shell first quarter-sphere piece 34, mantle shell second quarter-sphere piece 37, mantle shell third quarter-sphere piece 38, mantle shell fourth quarter-sphere piece 39, first cover piece 22, and second cover piece 23, as well as an adhesive 82 and solvent 84. According to aspects set forth herein, golfer 80 may join the multiple layers together using adhesive 82, such as a thermoplastic adhesive, or by other suitable method as is well-known in the art. This may include placing ends 46 of tenons 44 in core apertures 42 and joining by adhesive 82, as well as by placing mantle apertures 36 of mantle shell 30 over ends 48 of tenons 44 and joining by adhesive 82. After internal ball 50 is assembled by joining core 40, tenons 44 and mantle shell 30, golfer 80 may join first cover piece 22 and second cover piece 23 to form a cover 20 of golf ball 10 such that a seam line 26 is offset from seam line 12 and seam line 14 (or any other seam line created by a mantle shell layer). After cover 20 is secured, a golfer may also apply a top coating to the cover as is known in the art. After assembly, golf ball 10 may be ready for play by golfer 80 as shown in FIG. 9.

Figure 10:
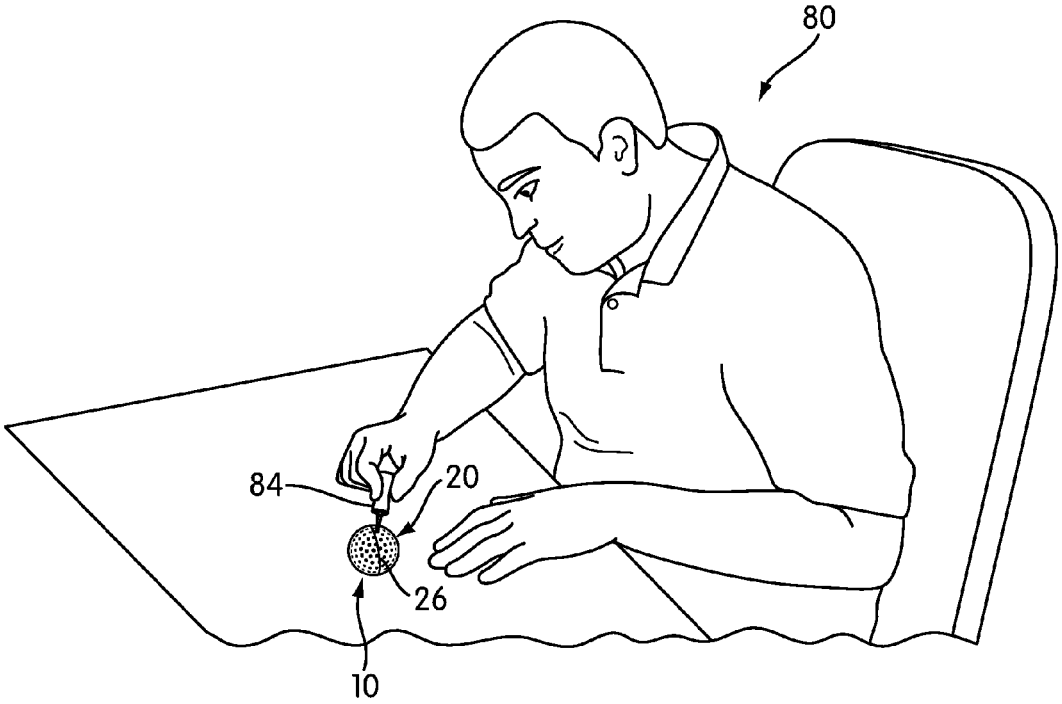
FIG. 10 is a perspective view of a golfer disassembling an embodiment of a customizable golf ball.

According to aspects set forth herein, customizable golf ball 10 may also be disassembled after play to replace existing layers with layers of a varying material or hardness layer to achieve a different feel, or simply to replace old or worn out parts or layers. FIG. 10 depicts golfer 80 beginning disassembly of golf ball 10 by applying a solvent 84 to seam 26 of cover 20 to remove cover 20 from inner ball 50. Solvent 84 may be any solvent suitable for reversing the adhesive properties of an adhesive used during assembly, as would be readily known to those of skill in the art. Examples of solvents include but are not limited to water, alcohols, and acid compounds such as vinegar. In addition, a golfer may reverse adhesive properties by other known means, such as exposure to heat or other types of radiation, such as microwaves.

Figure 14:
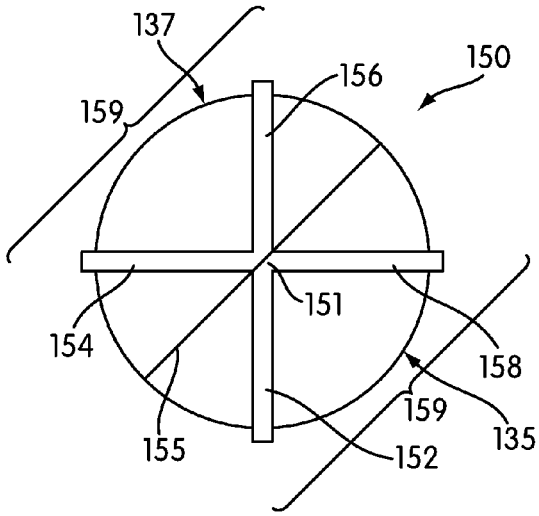
FIG. 14 is a top plan view of portions of another embodiment of a customizable golf ball.
Figure 15:
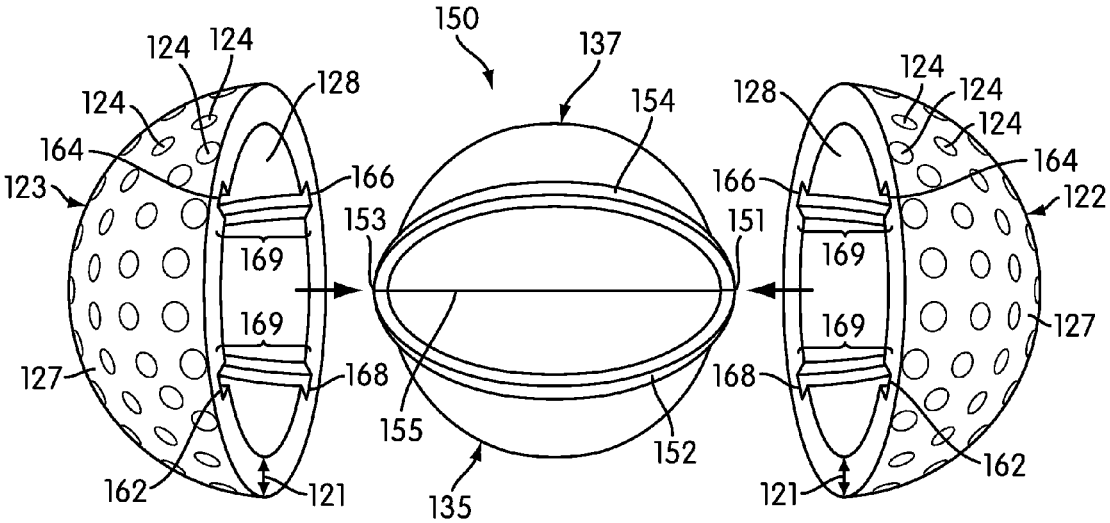
FIG. 15 is a partially exploded view of another embodiment of a customizable golf ball.
Figure 16:
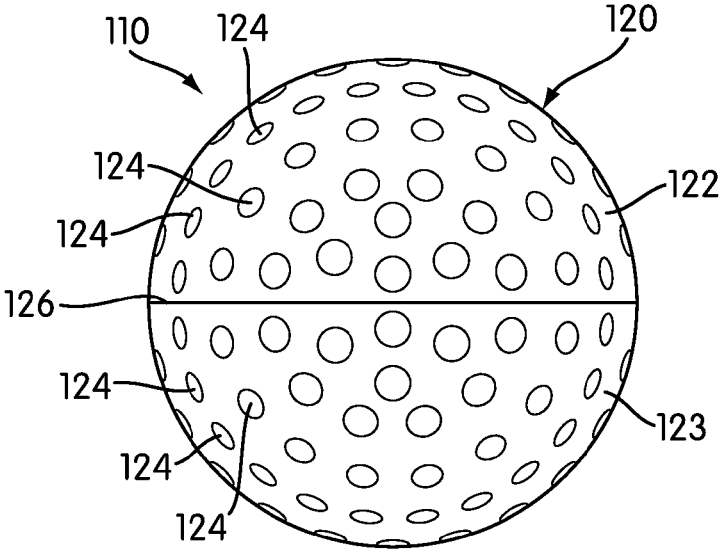
FIG. 16 is an elevational view of another embodiment of a customizable golf ball.

FIGS. 11-16 depict various layers of a customizable golf ball 110 according to an additional embodiment set forth herein. As seen in FIG. 16, which depicts an assembled golf ball 110 according to aspects set forth herein, the exterior surface of golf ball 110 may include external cover 120 made up of third cover piece 122 and fourth cover piece 123, joined at seam 126. Similar to the previously described embodiments, external cover 120 may be provided with a plurality of dimples 124, to create a dimple pattern as is known in the art.

Figure 11:
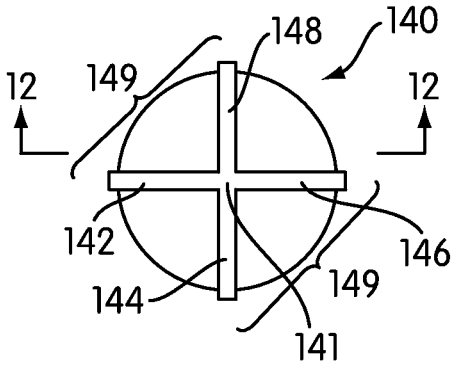
FIG. 11 is a top plan view of a portion of another embodiment of a customizable golf ball.
Figure 12:
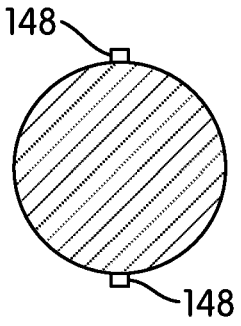
FIG. 12 is a cross-sectional view of the portion of the embodiment of a customizable golf ball depicted in FIG. 11, taken across lines 12-12.
Figure 13:
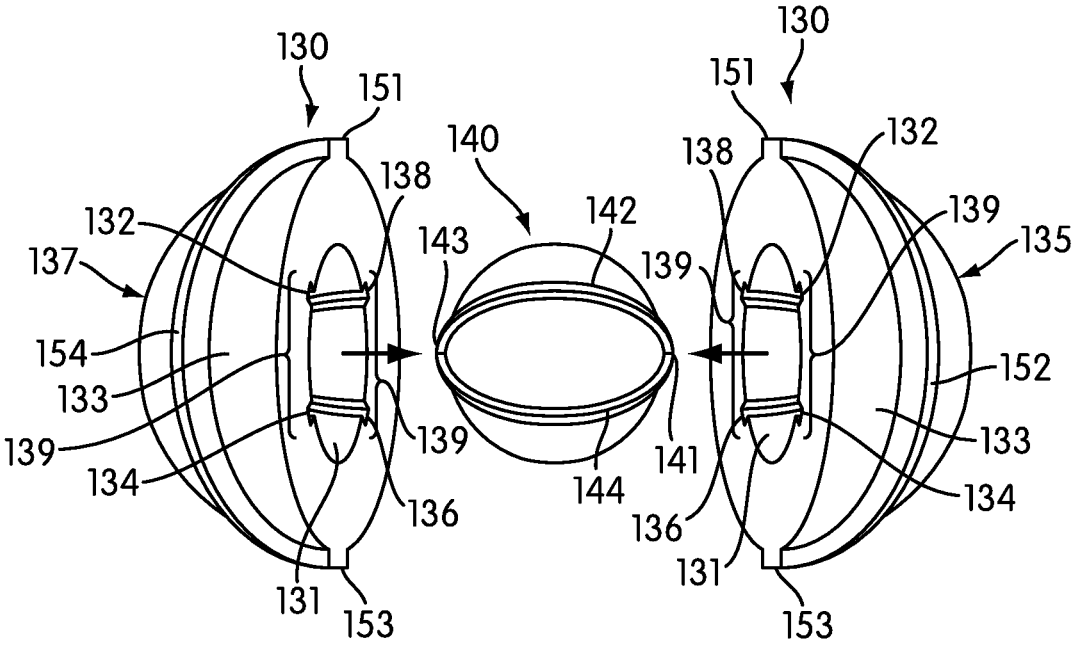
FIG. 13 is an exploded view of portions of another embodiment of a customizable golf ball.

Referring to the partial views in FIGS. 11-15, an embodiment of golf ball 110 may exhibit a layered structure having (a) cover 120 that forms an exterior portion of golf ball 110 (as seen in FIGS. 15 and 16), (b) an intermediate layer or mantle shell 130 under cover 120 (as seen in FIGS. 13-15), and (c) an internal core 140 that forms an interior portion of ball 110 (as seen in FIGS. 11-13). According to an embodiment set forth herein, core 140 and mantle shell 130 may also include a plurality of arcuate projections, i.e. first projection 142, second projection 144, third projection 146, and fourth projection 148 on core 140 and fifth projection 152, sixth projection 154, seventh projection 156, and eighth projection 158 on an exterior surface 133 of mantle shell 130. As previously discussed, a golfer may customize golf ball 110 by including layers of varying materials and varying hardnesses to achieve a desired playing characteristic, such as feel, spin, velocity, or trajectory.

According to an embodiment set forth herein, internal core 140 may comprise a solid spherical structure with a plurality of arcuate projections, first projection 142, second projection 144, third projection 146, and fourth projection 148, which may be referred to, collectively, as alternate core projections 149. Each of alternate core projections 149 may form an arcuate protrusion from a first end 141 (or pole) of core 140 to a second end 143 (or opposite pole) of core 140. Further, each of alternate core projections 149 may exhibit a rectangular-shaped cross-section as depicted in the cross-sectional view of FIG. 12. Those skilled in the art will appreciate that the number of alternate core projections 149 may be fewer or more than is depicted in FIGS. 11-13 and that the cross-sectional shape of alternate core projections 149 may be varied without altering the spirit and scope of the customizable golf ball set forth herein.

Referring to FIGS. 13-15, mantle shell 130 may be comprised of two half-sphere pieces, piece 135 and piece 137, according to at least one embodiment described herein. FIG. 13 depicts an exploded view of how mantle shell 130 may be placed over core 140 and FIGS. 14 and 15 depict the two layers in place together. Mantle shell 130 includes an interior surface 131 and an exterior surface 133, both of which may be sized and shaped to mate with core 140 and cover 120, respectively. In the embodiment depicted in FIGS. 13-15, interior surfaces 131 of intermediate layer piece 135 and piece 137 exhibit a plurality of spaced apart grooves, i.e., first groove 132, second groove 134, third groove 136, and fourth groove 138, which may be collectively referred to as interior grooves 139. Interior grooves 139 may be sized and shaped to receive alternate core projections 149 protruding from core 140 when lined up as depicted in FIG. 13. Thus, interior grooves 139 may exhibit a rectangular-shaped cross-section. The exterior surface 133 of mantle shell 130 may also include arcuate first exterior projection 152, second exterior projection 154, third exterior projection 156, and fourth exterior projection 158, which may be referred to, collectively, as exterior projections 159. Similar to alternate core projections 149 of core 140, exterior projections 159 may form an arc-shape protrusion from a first end 151 of mantle shell 130 to a second end 153 of mantle shell 130. Further, each of exterior projections 159 may exhibit a rectangular-shaped cross-section, similar to alternate core projections 149 of core 140. Again, those skilled in the art will appreciate that mantle shell 130 may comprise fewer or more pieces. Further, those of skill will readily acknowledge that the number of exterior projections 159 may be fewer or more than is depicted in FIGS. 13-15 and that the cross-sectional shape of exterior projections 159 may be varied without altering the spirit and scope of the customizable golf ball set forth herein.

Inner ball 150 may be covered by a cover layer 120 which may be formed by third cover piece 122 and fourth cover piece 123, as depicted in FIGS. 15-16. Cover layer 120 includes an exterior surface 127 and an interior surface 128 with a thickness 121 that is sized and shaped to mate with inner ball 150. In particular, thickness 121 may be decreased or increased based on the size of inner ball 150. In the embodiment depicted in FIGS. 15 and 16, interior surfaces 128 of cover layer piece 122 and piece 123 exhibit a plurality of spaced apart alternate cover grooves, i.e., first cover groove 162, second cover groove, 164, third cover groove 166, and fourth cover groove 168, which may be collectively referred to as cover grooves 169. Cover grooves 169 may be sized and shaped to receive exterior projections 159 protruding from inner ball 150 when lined up as depicted in FIG. 15. Thus, cover grooves 169 may exhibit a rectangular-shaped cross-section, but as discussed above, are not limited in this way. When fitted together as seen in FIG. 16, third cover piece 122 and fourth cover piece 123 form seam line 126. Referring to FIG. 15, seam line 126 of cover 120 may be offset from seam line 155 of mantle shell 130 to increase durability across the layers of golf ball 110.

Similar to previously discussed embodiments, internal core 140, intermediate mantle shell 130, cover 120 may all be made from a variety of thermoplastic or thermoset materials, as set forth above, in a variety of hardness levels to achieve desired playing characteristics. Further, it is contemplated that each piece of core 140, mantle shell 130 and cover 120 may be formed by one-time molding, by attaching alternate core projections 149 to core 140 and projections 139 to mantle shell 130 separately by thermoplastic adhesive, or by any other method known to those of skill. Thus, those skilled in the art will readily acknowledge the full breadth of materials available for use beyond those specified, as well as the method of forming the layers of golf ball 110, which would still fall within the spirit and scope of the present disclosure.

According to aspects described herein, the hardness of the layers of golf ball 110 may be assessed using techniques known in the art. In some cases, a durometer measurement may be taken on the surface of any of the layers of golf ball 110, as set forth above. According to the present disclosure, the hardness level of each of the layers of golf ball 110 may be dictated by the golfer assembling the customizable ball (assembly discussed in further detail below).

As previously discussed, to achieve a variety of desired playing characteristics, a golfer may customize golf ball 110 by using materials of varying hardness levels for the multiple layers of golf ball 110. For example, core 140 may have the same or a different surface hardness level from that of mantle shell 130. Likewise, the hardness level of core 140 and mantle shell 130 may each be higher or lower in relation to the hardness level of cover 120. In addition, alternate core projections 149 on core 140 and exterior projections 159 on mantle shell 130 may have the same or a different surface hardness level from that of the other layers of golf ball 110. As is known in the art, the variation in hardness levels among the multiple layers can create a different feel when the ball is hit. A golfer may customize the feel of golf ball 110 to his/her particular skill level or liking by using layers and/or projections of varying hardness levels, varying thicknesses or varying materials throughout golf ball 110.

Customizable golf ball 110 may be assembled by a golfer in the manner depicted in FIGS. 13 and 15. According to aspects set forth herein, and similar to the assembly described above in relation to FIG. 8, a golfer may join the multiple layers together using adhesive, such as a thermoplastic adhesive, or by other suitable method as is well-known in the art. This may include placing alternate core projections 149 of core 140 in interior grooves 139 of mantle core 130 and securing with adhesive, as well as by placing exterior projections 159 of mantle shell 130 in cover grooves 169 of cover 120 and securing with adhesive. After cover 120 is secured, a golfer may also apply a top coating to the cover as is known in the art. After assembly, golf ball 110 may be ready for play by the golfer.

Likewise, customizable golf ball 110 may also be disassembled after play to switch out layers to achieve a different "feel" or to replace old or worn out parts or layers. Disassembly of golf ball 110 may be accomplished by applying a solvent as discussed above, or by using any suitable means known in the art for reversing adhesive properties of an adhesive used during assembly.

Figure 17:
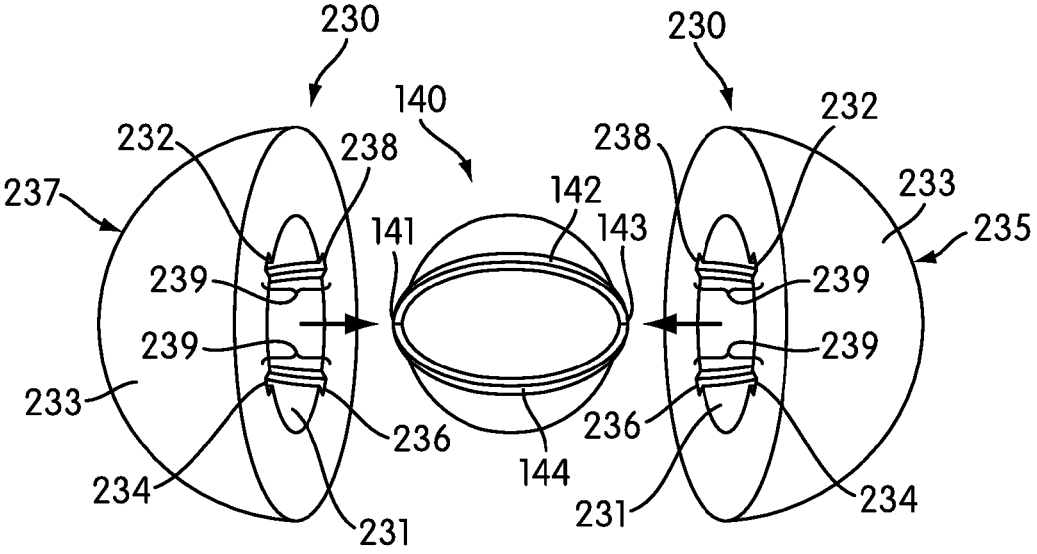
FIG. 17 is an exploded view of portions of an additional embodiment of a customizable golf ball.
Figure 18:
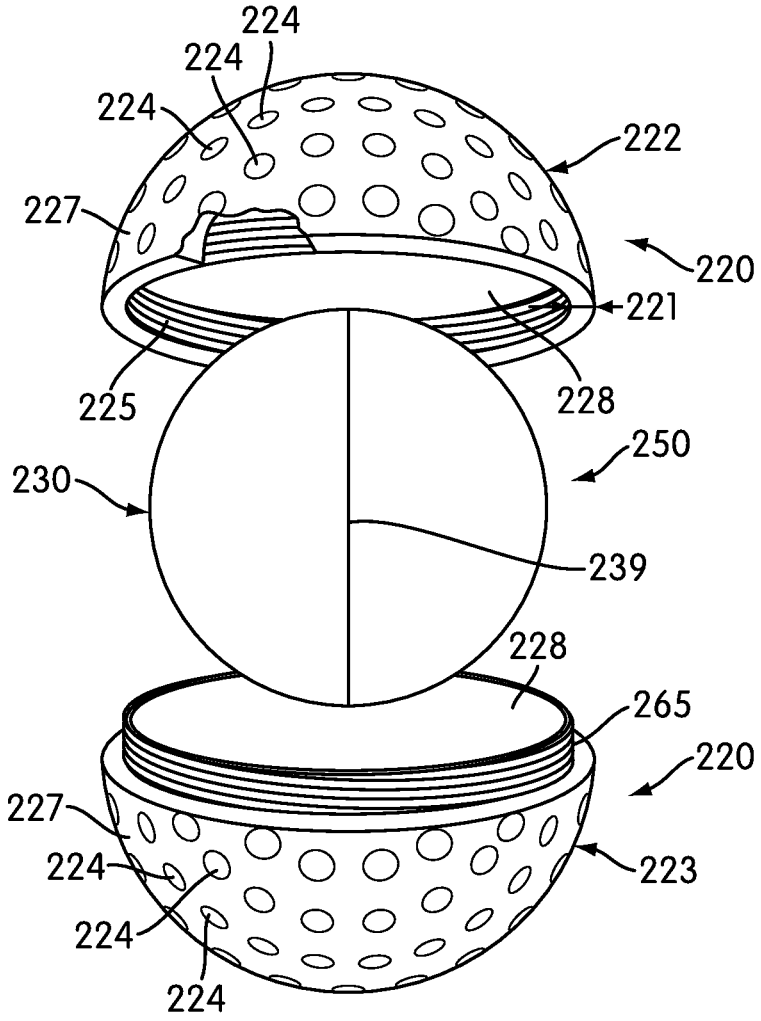
FIG. 18 is a partially exploded view of the additional embodiment of a customizable golf ball.
Figure 19:
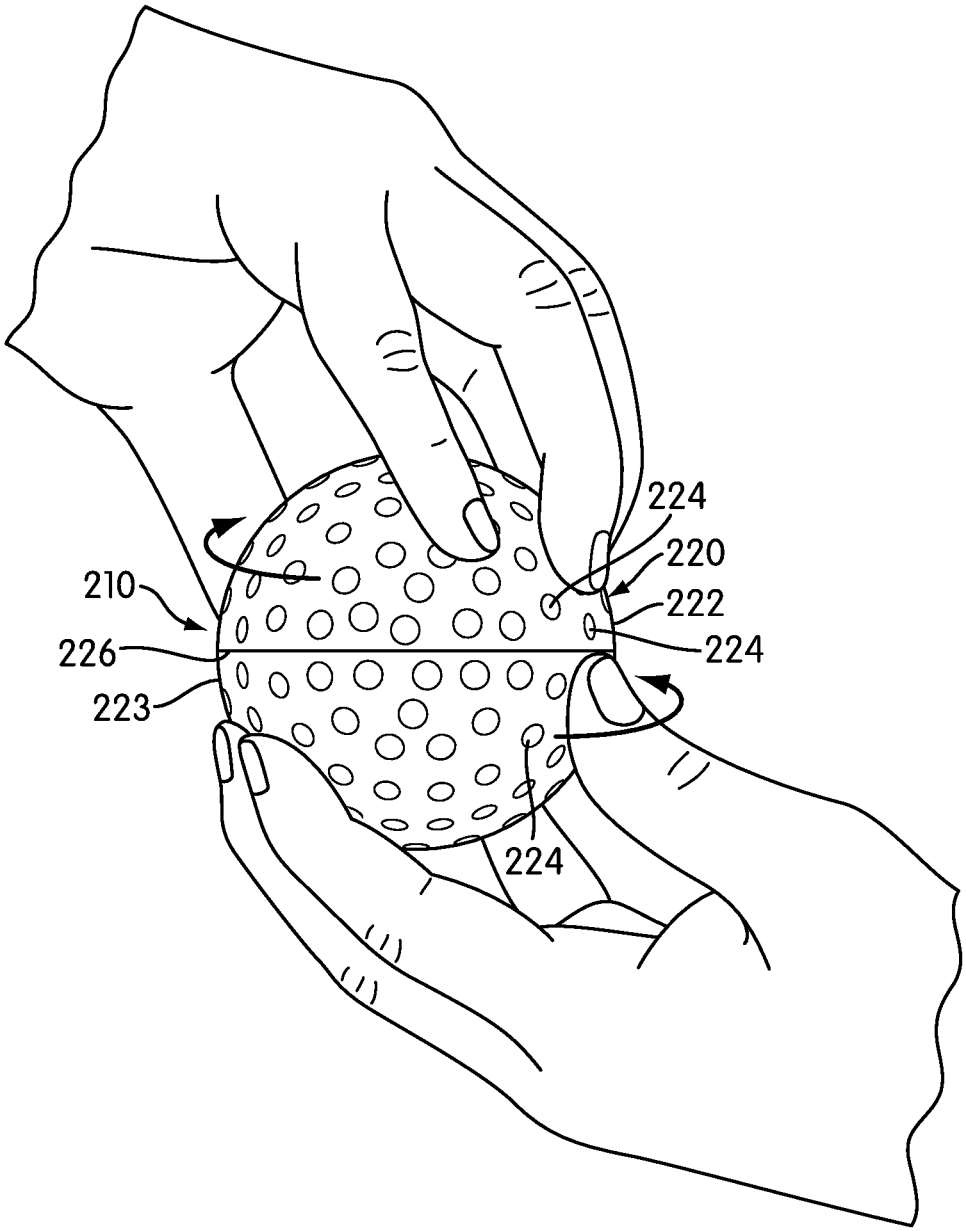
FIG. 19 is a perspective view of a golfer assembling the additional embodiment of a customizable golf ball.

FIGS. 17-19 depict various layers of a customizable alternate golf ball 210 according to yet another embodiment set forth herein. As seen in FIG. 19, which depicts an assembled alternate golf ball 210 according to aspects set forth herein, the exterior surface of alternate golf ball 210 may include external cover 220 made up of fifth cover piece 222 and sixth cover piece 222, joined at seam 226. Again, similar to the previously described embodiments, external cover 220 may be provided with a plurality of dimples 224, to create dimple pattern as is known in the art.

Referring to the partial views in FIGS. 17 and 18, the embodiment of alternate golf ball 210 may exhibit a layered structure similar to previous embodiments having (a) cover 220 that forms an exterior portion of alternate golf ball 210, (b) an intermediate layer or mantle shell 230 under cover 120 (as seen in FIGS. 17 and 18), and (c) an internal core 140 that forms an interior portion of ball 210 (as seen in FIG. 17 and previously described in relation to FIGS. 11-13). As previously discussed, a golfer may customize alternate golf ball 210 by including layers of varying materials and varying hardnesses to achieve a desired playing characteristic, such as feel, spin, velocity, or trajectory.

According to the embodiment set forth herein and depicted in FIG. 17, internal core 140 may comprise a solid spherical structure with a plurality of arcuate projections, first core projection 142, second core projection 144, third core projection 146, and fourth core projection 148, referred to, collectively, as alternate core projections 149. Internal core 140 is discussed above in relation to FIGS. 11-13, and those skilled in the art will appreciate that the exact configuration of internal core 140 may be varied without altering the spirit and scope of the customizable golf ball set forth herein.

Referring to FIGS. 17 and 18, mantle shell 230 of alternate golf ball 210 may be comprised of two half-sphere pieces, piece 235 and piece 237, according to an embodiment described herein. FIG. 17 depicts an exploded view of how mantle shell 230 may be placed over core 140 and FIG. 18 depicts mantle shell 230 and core 140 together as inner ball 250. Mantle shell 230 includes an interior surface 231 and an exterior surface 233, both of which may be sized and shaped to mate with core 140 and cover 220, respectively. In the embodiment depicted in FIGS. 17-19, interior surfaces 231 of first intermediate layer piece 235 and second intermediate layer piece 237 exhibit a plurality of spaced apart intermediate grooves, i.e., first intermediate groove 232, second intermediate groove 234, third intermediate groove 236, and fourth intermediate groove 238, which may be collectively referred to as intermediate grooves 239. Intermediate grooves 239 may be sized and shaped to receive alternate core projections 149 protruding from core 140 when lined up as depicted in FIG. 17. Thus, intermediate grooves 239 may exhibit a rectangular-shaped cross-section. According to one embodiment, the exterior surface 233 of mantle shell 230 may be smooth. Again, those skilled in the art will appreciate that the configuration of mantle shell 230 may be varied without altering the spirit and scope of the customizable alternate golf ball 210 set forth herein.

Inner ball 250 may be covered by an alternate cover layer 220 which may be formed by fifth cover piece 222 and sixth cover piece 222, as depicted in FIGS. 18 and 19. Alternate cover layer 220 includes an exterior surface 227 and an interior surface 228 with a thickness 221 that is sized and shaped to mate with inner ball 250. In particular, thickness 221 may be decreased or increased based on the size of inner ball 250. In the embodiment depicted in FIGS. 17-19, interior surfaces 228 of cover layer piece 222 and piece 223 are smooth to fit against the exterior surface 233 or mantle shell 230.

Alternate cover layer 220 may include provisions for securing fifth cover piece 222 and sixth cover piece 223. In particular, fifth cover piece 222 and sixth cover piece 223 may further include threaded area 225 and threaded area 265, respectively. Threads 225 may be positioned on an interior surface 228 of fifth cover piece 222 and configured to engage with threads 265, positioned slightly inward of exterior surface 227 of sixth cover piece 223. Threaded areas 225 and threaded area 265 may be engaged and secured in a manner similar to engaging a cap on a bottle.

Similar to previously discussed embodiments, internal core 140, intermediate mantle shell 230, alternate cover 220 may all be formed according to methods set forth above and may be made from a variety of thermoplastic or thermoset materials, as set forth above, in a variety of hardness levels to achieve desired playing characteristics. Those skilled in the art will readily acknowledge the full breadth of materials available for use beyond those specified, as well as the breadth of methods available for forming the layers of alternate golf ball 210, that would still fall within the spirit and scope of the present disclosure.

As previously discussed, to achieve a variety of desired playing characteristics, a golfer may customize alternate golf ball 210 by using materials of varying hardness levels for the multiple layers of alternate golf ball 210. As is known in the art, the variation in hardness levels among the multiple layers can create a different feel when the ball is hit. A golfer may customize the feel of alternate golf ball 210 to his/her particular skill level or liking by using layers and/or projections of varying hardness levels, varying thicknesses or varying materials throughout alternate golf ball 210.

Alternate golf ball 210 may be assembled by a golfer as previously discussed, and in the manner depicted in FIGS. 17-19. According to aspects set forth herein, a golfer may join the multiple layers together using adhesive, such as a thermoplastic adhesive, or by other suitable method as is well-known in the art. This may include placing alternate core projections 149 of core 140 in grooves 239 of mantle core 230 as shown in FIG. 17, and securing with adhesive to form inner ball 250. Further, inner ball 250 may be placed within alternate cover 220 as shown in FIG. 18, and threaded area 225 of fifth cover piece 222 and threaded area 265 of sixth cover piece 223 may be engaged as shown in FIG. 19. Seam line 226 of alternate cover 220 may be offset from seam line 239 of mantle shell 230 to increase durability across the layers of alternate golf ball 210. When joined, fifth cover piece 222 and sixth cover piece 223 form seam line 226. After alternate cover 220 is secured, a golfer may also apply a top coating to the cover as is known in the art. After assembly, alternate golf ball 210 may be ready for play by the golfer.

Customizable alternate golf ball 210 may also be disassembled after play to switch out layers to achieve a different feel or to replace old or worn out parts or layers. Disassembly of alternate golf ball 210 may be accomplished by disengaging threaded area 225 and threaded area 265 of cover layer 220, and applying a solvent as discussed above to those layers secured with adhesive, or by using other suitable means known in the art for reversing adhesive properties of an adhesive used during assembly.

Figure 20:
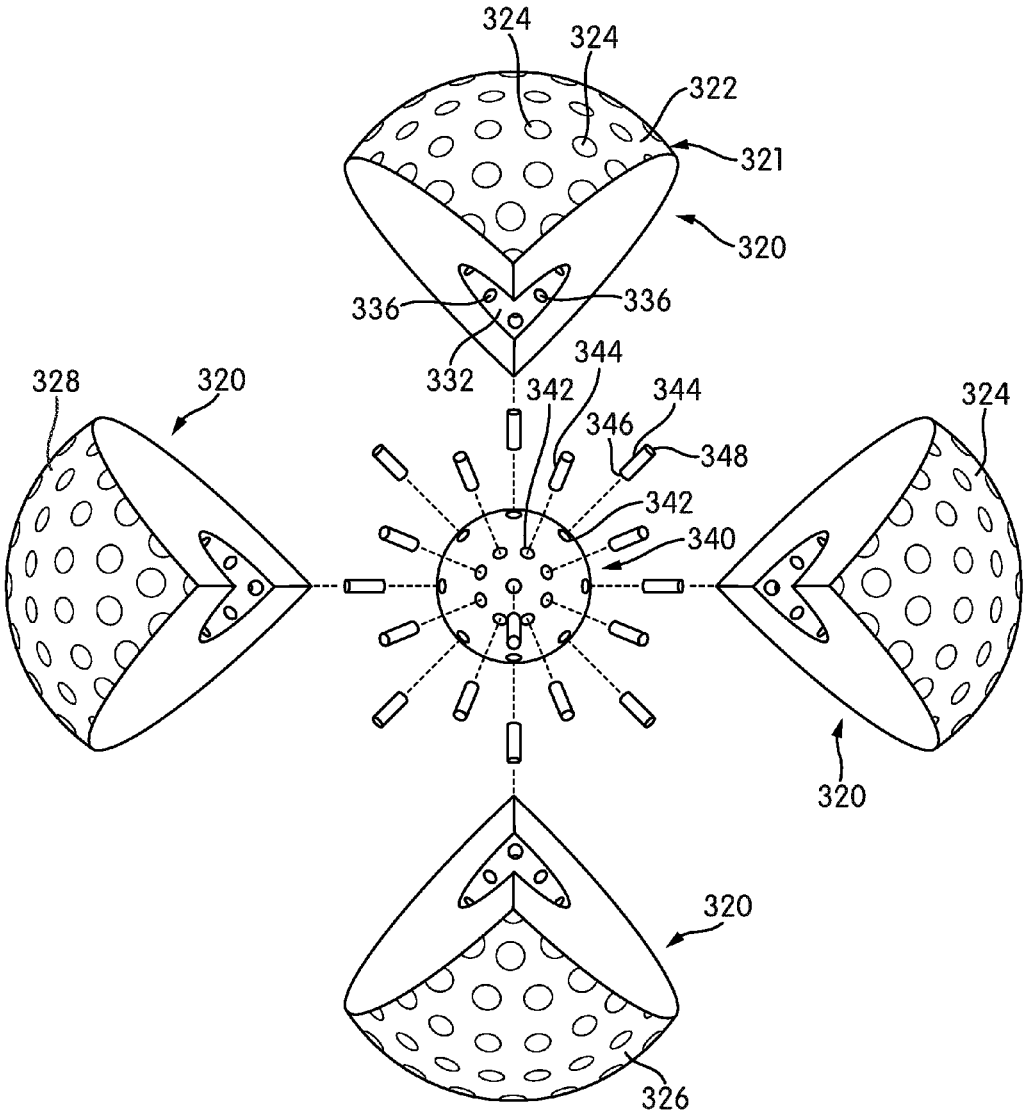
FIG. 20 is an exploded view of yet another embodiment of a customizable golf ball.
Figure 21:
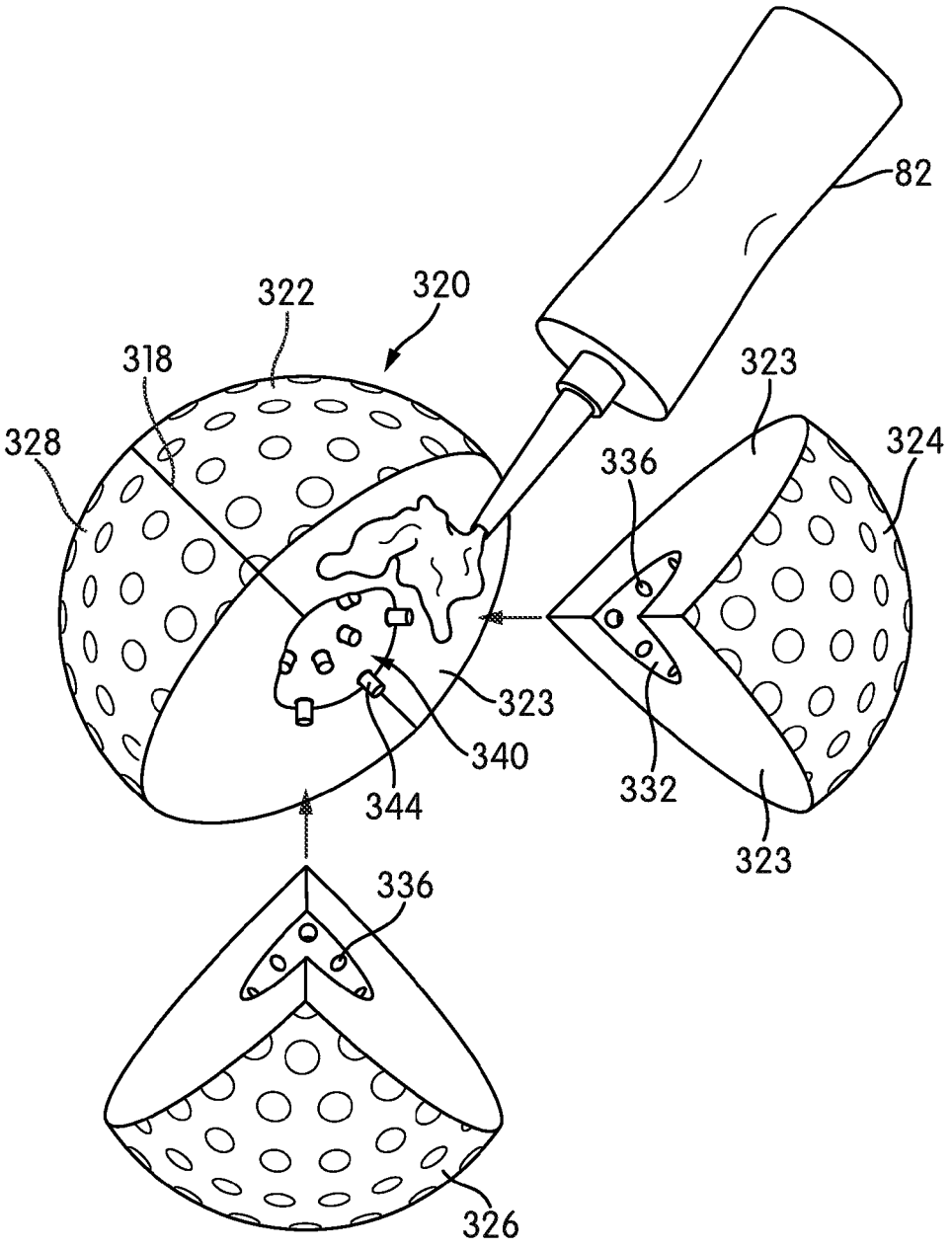
FIG. 21 is a perspective view of the embodiment of a customizable golf ball depicted in FIG. 20 during assembly.
Figure 22:
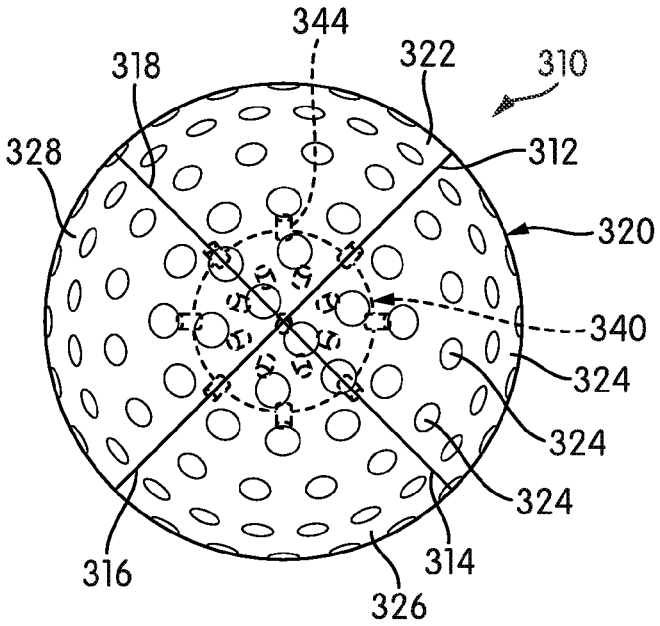
FIG. 22 is an elevational view of the embodiment of a customizable golf ball depicted in FIG. 20.

FIGS. 20-22 and FIGS. 23-24 depict various layers and views of customizable golf balls 310 and 410, respectively, according to additional embodiments set forth herein. Referring to FIG. 22, which depicts an assembled golf ball 310 according to aspects set forth herein, the exterior surface of golf ball 310 may include external cover 320 made up of seventh cover piece 322, eighth cover piece 324, ninth cover piece 326 and tenth cover piece 328. In at least one configuration, seventh cover piece 322, eighth cover piece 324, ninth cover piece 326 and tenth cover piece 328 may each have a general shape of a quarter sphere, and may be joined together at seam 312, seam 314, seam 316 and seam 318, respectively. Similar to the previously described embodiments, external cover 320 may be provided with a plurality of dimples 324, to create a dimple pattern as is known in the art.

As depicted in the exploded view of golf ball 310 in FIG. 20, an embodiment of customizable golf ball 310 exhibits a layered structure having: a cover 320 that forms an exterior portion of golf ball 310; and an internal core 340 that forms an interior portion of ball 310. According to an embodiment set forth herein, golf ball 310 may also include a plurality of tenons 344 situated in apertures or core mortises 342 on core 340 as well as in cover mortises 336 on an interior surface 332 of cover 320. Similar to the previously discussed embodiments, a golfer may customize golf ball 310 by selecting layers of varying materials and varying hardnesses to achieve desired performance or playing characteristics, such as feel, spin, velocity or trajectory.

According to at least one embodiment, and similar to previously discussed embodiments, the internal core 340 may comprise a solid spherical structure with a plurality of core apertures 342 spaced evenly over the surface of core 340 for receiving a plurality of cylindrical tenons 344, as shown in FIG. 20. Core apertures 342 may be sized and shaped to receive similarly sized and shaped tenons 344. Tenons 344 may be cylindrically shaped with a first end 346 placed in an aperture 342 on core 340 and a second end 348 placed in a similarly sized and shaped aperture 336 on an interior surface 332 of cover 320. Those skilled in the art will appreciate that the number of tenons 344 may be fewer or more than is depicted in FIGS. 20-22 and still achieve the desired effect, described below. Furthermore, those skilled in the art will readily appreciate that the tenon/mortise construction disclosed in the embodiment of FIGS. 20-22 may also be achieved using a variety of different shapes, such as triangular-shaped tenons, rectangular-shaped tenons, pentagonal-shaped tenons, hexagonal-shaped tenons, or other kind of polygonal-shaped tenons, without altering the spirit and scope of the customizable golf ball set forth herein.

According to aspects described herein, cover 320 may be comprised of four quarter-sphere pieces, seventh cover piece 322, eighth cover piece 324, ninth cover piece 326 and tenth cover piece 328. FIG. 20 depicts an exploded view of how cover 320 may be placed over core 340 and FIG. 22 depicts the two layers in place together. As depicted, cover 320 has an exterior surface 321 as well as an interior surface 332 that is sized and shaped to mate with core 340. In the embodiment depicted in FIGS. 20 and 21, interior surfaces 332 of seventh cover piece 322, eighth cover piece 324, ninth cover piece 326 and tenth cover piece 328 each exhibit a plurality of spaced apart cylindrically-shaped apertures 336 that are sized and shaped to receive cylindrically-shaped tenons 344 protruding from core 340. When fitted together as seen in FIG. 22, core 340, tenons 344 and cover 320 together create a tenon and mortise construction, similar to previous embodiments, and seventh cover piece 322, eighth cover piece 324, ninth cover piece 326 and tenth cover piece 328 of cover 320 fit together along seam line 312 and seam line 314.

Similar to previously discussed embodiments, FIG. 21 depicts an exploded view of how cover 320 may be placed over core 340 to create finished golf ball 310 (as seen in FIG. 22). In particular, according to aspects set forth herein, a golfer may join the multiple layers together using an adhesive 82, such as a thermoplastic adhesive, or by other suitable method as is well-known in the art. This may include placing ends 346 of tenons 344 in core apertures 342 and joining by adhesive 82 to create an assembled core 340. After assembled core 340 is constructed, a golfer may place cover apertures 336 of each quarter-sphere of cover 330 over ends 348 of tenons 344, joining each quarter-sphere of cover 320 both to core 320 and an adjoining quarter-sphere. As may be seen in FIG. 21, adjoining flat surfaces 323 of seventh cover piece 322, eighth cover piece 324, ninth cover piece 326 and tenth cover piece 328 may be joined together and sealed with adhesive 82. After cover 320 is secured, a golfer may also apply a top coating to the cover as is known in the art (not shown).

Likewise, customizable golf ball 310 may also be disassembled after play to switch out layers to achieve a different feel or to replace old or worn out parts or layers. Disassembly of golf ball 310 may be accomplished by applying a solvent as discussed above, or by using any suitable means known in the art for reversing adhesive properties of an adhesive used during assembly.

Core 340, tenons 344 and cover 320 may all be made from a variety of thermoplastic or thermoset materials, as set forth in relation to previously discussed embodiments, in a variety of hardness levels to achieve desired playing characteristics. Further, those skilled in the art will readily acknowledge the full breadth of materials available for use beyond those specified, that would still fall within the spirit and scope of the present disclosure.

According to the present disclosure, the surface hardness level relationship between the layers of golf ball 310 may be dictated by the golfer assembling the customizable ball in order to customize playing characteristics of the ball. As previously discussed, to achieve a variety of desired playing characteristics, a golfer may customize golf ball 310 by using materials of varying hardness levels for the multiple layers of golf ball 310. For example, core 340 may have the same or a different hardness level from that of cover 320. Likewise, the hardness level of tenons 344 may be higher or lower in relation to the hardness levels of core 340 and cover 320. Each of the hardness levels of the varying layers of golf ball 310 may be assessed using the standard techniques discussed above and as would be well-known in the art. For example, in some cases, a durometer measurement may be taken using the ASTM D2240 Type D scale (also known as Shore D).

Figure 23:
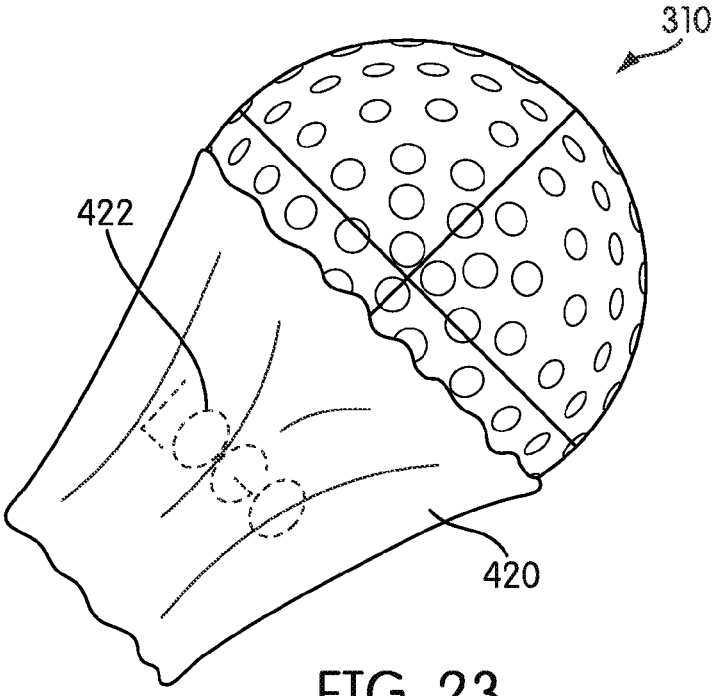
FIG. 23 is an elevational view of yet another embodiment of a customizable golf ball during assembly.
Figure 24:
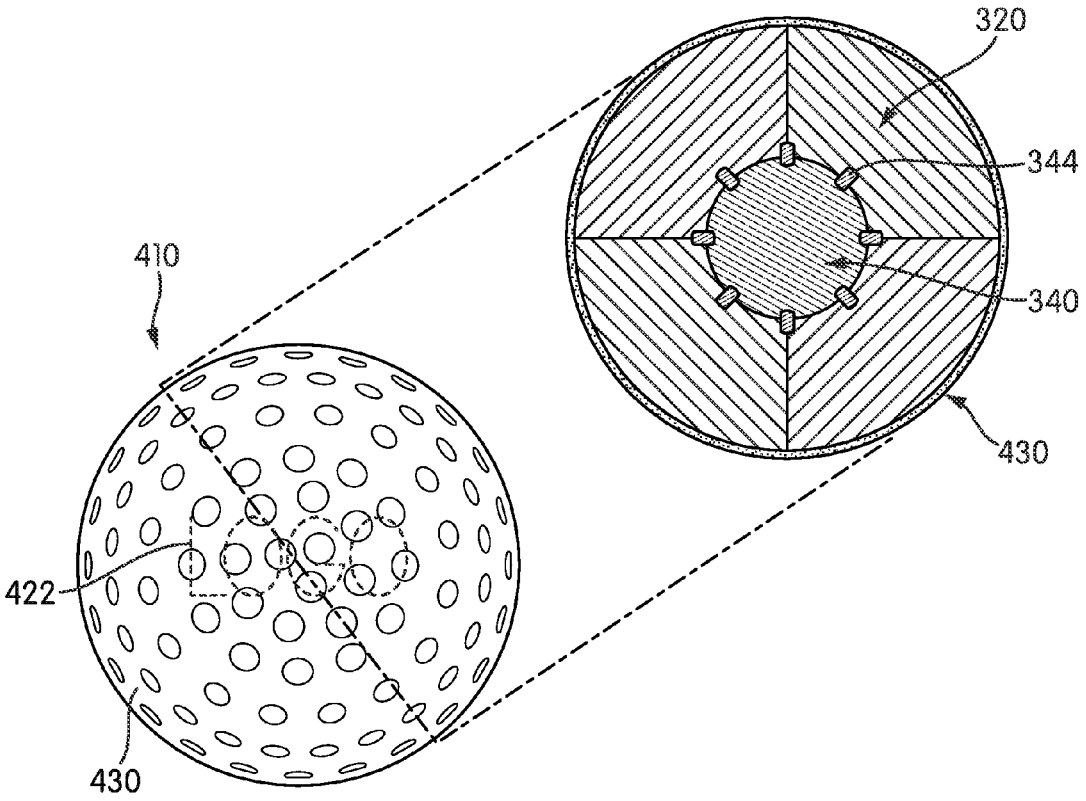
FIG. 24 is an elevational view and a cross-sectional view of the embodiment of a customizable golf ball depicted in FIG. 23.

According to aspects set forth herein, a golf ball may be further enhanced with an outer layer to provide additional stability to the surface of the golf ball or to enhance the aesthetics of the golf ball. For example, in some cases, a thin outer layer may be applied to further seal seam lines or to provide a color or other aesthetic effect to the ball. Referring to FIGS. 23 and 24, in at least one configuration, a golf ball such as golf ball 310 may be inserted in a heat-shrinkable sleeve 420 to create an outer layer 430 when heat is applied to heat-shrinkable sleeve 420.

Heat-shrinkable sleeve 420 may be sized to fit snugly around a golf ball, such as golf ball 310 in FIG. 23. Heat-shrinkable sleeve 420 may be made of any malleable and heat-shrinkable material known in the art. In at least one configuration, sleeve 420 may be made of a thermoplastic polymer membrane that will shrink to the surface of golf ball 310 when heated, for example, by dipping in a boiling water bath or other method contemplated by a skilled artisan. Once heated, sleeve 420 may conform to the surface of golf ball 310 to create an outer layer 430 and additional embodiment, i.e., golf ball 410 of FIG. 24. In some cases, heat-shrinkable sleeve 420 may be colored or improved with an indicia 422 to also enhance the aesthetics of the golf ball.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of assembling a customized golf ball comprising:

providing an inner core piece, wherein the inner core piece comprises a first hardness;

assembling at least two preformed intermediate layer pieces about the inner core piece, wherein the at least two intermediate layer pieces comprise a second hardness that is different than the first hardness, wherein interior surfaces of the at least two preformed intermediate layer pieces are configured to interlock with an exterior surface of the inner core piece, and wherein the at least two intermediate pieces form a sphere when joined together;

assembling at least two preformed cover pieces about the at least two preformed intermediate layer pieces, wherein the at least two cover pieces comprise a third hardness, wherein interior surfaces of the at least two preformed cover pieces are configured to interlock with an exterior surface of the at least two intermediate layer pieces, and wherein the at least two cover pieces form a sphere when joined together; and wherein the at least two cover pieces further comprise threaded edges, and wherein the threaded edges are configured to engage with each other.

2. The method according to claim 1, further comprising providing a thermoplastic adhesive for connecting the inner core piece, the at least two intermediate layer pieces and the at least two cover pieces.

3. The method according to claim 1, wherein the inner core further comprises a plurality of apertures for receiving a plurality of tenons.

4. The method according to claim 3, wherein the interior surfaces of the at least two intermediate layer pieces further comprise a plurality of apertures for receiving the plurality of tenons.

5. The method according to claim 1, wherein the first hardness is less than the second hardness.

6. The method according to claim 1, wherein the at least two intermediate layer pieces comprise four adjoining quarter spheres.

7. The method according to claim 1, wherein the at least two intermediate layer pieces comprise two adjoining half spheres.

8. The method according to claim 1, wherein the first hardness is in a range from about 30 to about 65 Shore D, wherein the second hardness is in a range from about 40 to about 80 Shore D, and wherein the third hardness is in a range from about 25 to about 60 Shore D.

9. The method according to claim 3, wherein the plurality of tenons comprise a fourth hardness, and wherein the fourth hardness is different than the first hardness.

10. The method according to claim 1, wherein the inner core piece includes a plurality of arcuate protrusions, wherein the arcuate protrusions are evenly spaced around the inner core piece, and wherein the arcuate protrusions begin at one pole of the inner core piece and end at an opposite pole of the inner core piece.

11. The method according to claim 10, wherein the inner core piece comprises four arcuate protrusions.

12. The method according to claim 10, wherein the interior surfaces of the at least two intermediate pieces further comprise a plurality of grooves, wherein the plurality of grooves are spaced to receive the arcuate protrusions of the inner core piece.

13. The method according to claim 1, wherein the exterior surfaces of the at least two intermediate layer pieces include a plurality of arcuate protrusions, wherein, when the at least two intermediate layer pieces are joined to form a sphere, the arcuate protrusions are evenly spaced around the sphere and begin at a pole of the sphere and end at an opposite pole of the sphere.

14. The method according to claim 13, wherein the interior surfaces of the at least two cover pieces further comprise a plurality of grooves, wherein the plurality of grooves are spaced to receive the arcuate protrusions of the at least two intermediate layer pieces.

15. A method of assembling a customized golf ball comprising:

providing an inner core piece, wherein the inner core piece includes a plurality of arcuate protrusions, wherein the arcuate protrusions are evenly spaced around the inner core piece, and wherein the arcuate protrusions begin at one pole of the inner core piece and end at an opposite pole of the inner core piece;

assembling at least two preformed intermediate layer pieces about the inner core piece, wherein the at least two preformed intermediate layer pieces form an intermediate layer spherical cover for the inner core piece, wherein each intermediate layer piece comprises an interior surface and an exterior surface, wherein the interior surfaces of the intermediate layer pieces include a plurality of grooves, wherein the plurality of grooves are spaced to receive the arcuate protrusions of the inner core piece;

assembling at least two preformed cover pieces about the intermediate layer spherical cover, wherein the at least two preformed cover pieces form a spherical cover for the at least two intermediate layer pieces, wherein each cover piece comprises an interior surface and an exterior surface, wherein the interior surfaces of the at least two cover pieces are configured to mate with the exterior surfaces of the at least two intermediate layer pieces; and wherein the at least two cover pieces further comprise threaded edges, and wherein the threaded edges are configured to engage with each other.

16. The method according to claim 15, wherein:

the exterior surfaces of the at least two intermediate layer pieces include a plurality of arcuate protrusions, wherein the arcuate protrusions are evenly spaced around the at least two intermediate layer pieces, and when the at least two intermediate layer pieces are together, the arcuate protrusions of the intermediate layer pieces begin at one pole of the intermediate layer spherical cover and end at an opposite pole of the intermediate layer spherical cover; and the interior surfaces of the at least two cover pieces include a plurality of grooves, wherein the plurality of grooves are spaced to receive the arcuate protrusions of the at least two intermediate layer pieces.

* * * * *